US008347986B2

(12) United States Patent
Anderele

(10) Patent No.: US 8,347,986 B2
(45) Date of Patent: Jan. 8, 2013

(54) ROLLER CONE DRILL BIT WITH LUBRICANT PRESSURE RELIEF MECHANISM AND METHOD

(75) Inventor: Seth Garrett Anderele, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 316 days.

(21) Appl. No.: 12/831,766

(22) Filed: Jul. 7, 2010

(65) Prior Publication Data

US 2011/0017514 A1 Jan. 27, 2011

Related U.S. Application Data

(60) Provisional application No. 61/227,911, filed on Jul. 23, 2009.

(51) Int. Cl.
*E21B 10/24* (2006.01)

(52) U.S. Cl. ..... 175/228

(58) Field of Classification Search ..... 175/228, 175/229, 371
See application file for complete search history.

(56) References Cited

U.S. PATENT DOCUMENTS

| | | | | | |
|---|---|---|---|---|---|
| 3,476,195 | A | * | 11/1969 | Galle | 175/228 |
| 3,746,195 | A | | 7/1973 | Beilke et al. | 214/506 |
| 3,844,364 | A | | 10/1974 | Crow | 175/228 |
| 3,942,596 | A | | 3/1976 | Millsapps | 175/227 |
| 4,014,595 | A | | 3/1977 | Dolezal | 308/8.2 |
| 4,019,785 | A | | 4/1977 | Stinson et al. | 308/8.2 |
| 4,055,225 | A | * | 10/1977 | Millsapps | 175/228 |
| 4,161,223 | A | | 7/1979 | Oelke | 175/228 |
| 4,335,791 | A | | 6/1982 | Evans | 175/228 |
| 4,519,719 | A | | 5/1985 | Burr | 384/94 |
| 4,552,228 | A | | 11/1985 | Evans et al. | 175/228 |
| 4,577,705 | A | * | 3/1986 | Cross | 175/228 |
| 4,593,775 | A | | 6/1986 | Chaney et al. | 175/228 |
| 4,865,136 | A | | 9/1989 | White | 75/227 |
| 5,072,795 | A | | 12/1991 | Delgado et al. | 175/228 |
| 5,558,172 | A | | 9/1996 | Millsapps | 175/228 |
| 6,138,778 | A | | 10/2000 | Price et al. | 175/228 |
| 6,196,339 | B1 | | 3/2001 | Portwood et al. | 175/371 |
| 6,202,766 | B1 | | 3/2001 | Shepherd | 175/228 |
| 6,213,228 | B1 | * | 4/2001 | Saxman | 175/228 |
| 6,390,209 | B2 | * | 5/2002 | Saxman | 175/228 |
| 6,431,293 | B1 | | 8/2002 | Portwood et al. | 175/371 |
| 6,578,647 | B2 | * | 6/2003 | Page et al. | 175/228 |
| 6,619,412 | B2 | | 9/2003 | Slaughter et al. | 175/228 |
| 6,679,342 | B2 | | 1/2004 | Portwood et al. | 175/371 |
| 6,695,079 | B2 | | 2/2004 | Portwood et al. | 175/371 |

(Continued)

OTHER PUBLICATIONS

International Preliminary Report on Patentability and Written Opinion; Application No. PCT/US2010/041184; pp. 8, Feb. 2, 2012.

*Primary Examiner* — Jennifer H Gay
(74) *Attorney, Agent, or Firm* — Baker Botts L.L.P.

(57) ABSTRACT

Roller cone drill bits may be provided with pressure relief mechanisms operable to control lubricant pressure within respective lubricant systems. Each lubricant system may be enclosed and isolated from downhole well fluids. Portions of each pressure relief mechanism may be completely surrounded by lubricant to increase downhole life of associated operating mechanisms and to produced more repeatable and more reliable opening and closing of the pressure relief mechanism. The downhole drilling life of bearing surfaces, fluid seals and other supporting structures associated with roller cones mounted on support arms of such roller cone drill bits may be substantially increased. Each pressure relief mechanism may be locked in a closed position to assist with filling the respective lubricant system with lubricant.

21 Claims, 5 Drawing Sheets

U.S. PATENT DOCUMENTS

| | | | | |
|---|---|---|---|---|
| 6,802,380 | B2 | 10/2004 | Blackman | 175/228 |
| 6,976,548 | B2 | 12/2005 | Neville et al. | 175/371 |
| 7,201,241 | B2 | 4/2007 | Neville et al. | 175/371 |
| 7,237,627 | B2 | 7/2007 | Richman et al. | 175/372 |
| 7,665,547 | B2 * | 2/2010 | Yong et al. | 175/228 |
| 2001/0006124 | A1 * | 7/2001 | Saxman | 175/228 |
| 2003/0062200 | A1 | 4/2003 | Blackman | 175/228 |
| 2005/0045387 | A1 | 3/2005 | Oliver et al. | 175/371 |
| 2005/0077087 | A1 | 4/2005 | Richman et al. | 175/228 |
| 2007/0181347 | A1 | 8/2007 | Neville et al. | 175/371 |
| 2008/0105467 | A1 | 5/2008 | Yong et al. | 175/228 |
| 2011/0017514 | A1 * | 1/2011 | Anderele | 175/229 |

* cited by examiner

ROLLER CONE DRILL BIT WITH LUBRICANT PRESSURE RELIEF MECHANISM AND METHOD

CROSS REFERENCE TO RELATED APPLICATIONS

This application claims the benefit under 35 U.S.C. §119 (e) of U.S. Provisional Application No. 61/227,911, entitled "ROLLER CONE DRILL BIT WITH LUBRICANT PRESSURE RELIEF MECHANISM AND METHOD," filed Jul. 23, 2009.

TECHNICAL FIELD

The present disclosure is related to roller cone drill bits with systems operable to lubricate associated roller cone bearing surfaces and more particularly to satisfactorily maintain lubricant pressure acting on associated bearing surfaces and fluid seals over a wide range of downhole operating conditions.

BACKGROUND OF THE DISCLOSURE

Roller cone drill bits have been and are currently used to form wellbores in subterranean formations. Such drill bits generally include at least one support arm and often three support arms. A respective cone assembly may be rotatably mounted on interior portions of each support arm.

Each cone assembly often includes a base with a cavity or opening formed therein. Each cone cavity may be sized to receive exterior portions of an associated journal or spindle to allow rotation of the cone assembly relative to the associated journal or spindle while drilling a wellbore. A wide variety of bearings, bearing assemblies, bearing surfaces, seals and/or other supporting structures may be disposed between interior portions of each cone assembly and exterior portions of the associated journal or spindle.

Roller cone drill bits often include lubricant systems to supply lubricant to journals, bearings, bearing assemblies, bearing surfaces, seals and/or other supporting structures associated with rotation of each cone assembly mounted on a respective support arm. A variety of lubricants may be used with roller cone drill bits to accommodate rotation of each cone assembly relative to the respective spindle. A wide variety of seals and seal assemblies may be used to block communication between downhole well fluids and lubricants associated with rotation of each cone assembly. Various types of systems have been used to maintain lubricant system pressure to minimize potential damage to bearings, bearing assemblies, seals, journals and other supporting structures associated with rotation of a cone assembly relative to an associated support arm.

SUMMARY OF THE DISCLOSURE

In accordance with teachings of the present disclosure, a roller cone drill bit may be formed with a lubricant system and associated pressure relief mechanism operable to relieve internal pressure of the lubricant system at a predetermined pressure differential relative to adjacent downhole well fluid pressure. Maintaining lubricant pressure relative to adjacent downhole well fluid pressure in accordance with teachings of the present disclosure may increase downhole drilling life of bearings, bearing assemblies, various supporting structures, seals and/or other components associated with rotation of roller cone assemblies on a roller cone drill bit.

For some applications a lubricant reservoir may be disposed within respective support arms of a roller cone drill bit to supply lubricant to bearing surfaces and/or other supporting structures associated with rotation of each roller cone assembly relative to an associated support arm. A pressure relief mechanism incorporating teachings of the present disclosure may be disposed within each lubricant reservoir to prevent or limit undesired increases in lubricant pressure relative to adjacent downhole well fluid pressure while drilling a wellbore. Various portions of the pressure relief mechanism including, but not limited to, a biasing mechanism may be disposed within the lubricant reservoir to protect the biasing mechanism from contact with adjacent downhole well fluids.

A relief mechanism incorporating teachings of the present disclosure may include one or more seals which prevent drilling fluids or other downhole well fluid from entering a lubricant reservoir when the relief mechanism is in its first, closed position. The relief mechanism may also have a second, open position allowing lubricant to escape from the lubricant reservoir and flow into adjacent portions of a wellbore. A biasing mechanism may apply sufficient force to the relief mechanism to compress an associated seal or seals and prevent undesired communication between downhole well fluids and lubricant when the relief mechanism is in its first, closed position. When differences between pressure within the lubricant reservoir and downhole well fluid pressure adjacent thereto exceed a preselected value, sufficient force may be applied to the relief mechanism by the pressure difference to overcome the biasing mechanism and move the seal or seals from the first, closed position to a second, open position allowing communication of lubricant from the lubricant reservoir.

Another aspect of the present disclosure may include a lubricant system for a roller cone drill bit having a pressure relief mechanism operable to maintain lubricant pressure within a desired range relative to the pressure of adjacent downhole well fluids. The lubricant system may include a lubricant reservoir or container operable to store a desired lubricant therein. A pressure relief mechanism may be disposed within the lubricant container. The pressure relief valve may include a piston operable to move between a first, closed position and a second, open position. A biasing mechanism may releasably hold the pressure relief mechanism in its first, closed position. The biasing mechanism may be completely disposed in the lubricant reservoir to protect the biasing mechanism from downhole well fluids.

A further aspect of the present disclosure may include forming roller cone drill bits with one or more pressure relief mechanisms operable to control internal pressure in associated lubricant systems. For some applications, each lubricant systems may normally be completely enclosed and isolated from adjacent downhole well fluids. Operating portions of a pressure relief mechanism associated with each lubricant system such as a biasing mechanism, operable to maintain desired differences between lubricant system pressure and adjacent well fluid pressure, may be completely surrounded by lubricant to produce highly repeatable opening and closing of the pressure relief mechanism while at the same time substantially minimizing potential corrosion or other damage to the biasing mechanisms.

Teachings of the present disclosure may substantially minimize and/or reduce problems associated with prior lubricant pressure control mechanisms which may often have one or more components exposed to downhole well fluids. Excessive differential pressure between downhole well fluids surrounding exterior portions of a roller cone drill bit and lubricant system pressure may damage one or more seals resulting in uncontrolled loss of lubricant and/or downhole well fluid contact with associated journals, bearings, bearing surfaces, bearing assemblies and/or supporting structures and/or lubrication systems and associated seals which in turn often reduces downhole drilling life of the associated roller cone drill bit.

Teachings of the present disclosure often allow more reliable pressure control and pressure compensation of lubricant systems associated with roller cone drill bits and may prolong downhole drilling life of seals and other supporting structures associated with roller cones mounted on respective support arms. Improved pressure compensation of such lubricant systems may substantially increase downhole drilling life of associated roller cone drill bits and may substantially reduce the number of times that a drill string and associated roller cone drill bit must be returned to the well surface for maintenance, repair and/or replacement. The total cost of drilling a wellbore in a downhole formation may be substantially reduced by use of a roller cone drill bit with lubricant systems and pressure compensating mechanisms incorporating teachings of the present disclosure.

For some applications a roller cone drill bit having a pressure relief mechanism incorporating teachings of the present disclosure may provide substantial cost savings as compared with prior roller cone drill bits by increasing reliability of the roller cone drill bit over a wide range of downhole operating temperatures, pressure and other downhole conditions. One example may be pressure release mechanisms operable to be locked in a first, closed position while filing an associated lubrication system with lubricant to eliminate or substantially minimize any void spaces or gaps which are not filled with lubricant. The lock may be removed after filling the associated lubricant system to allow normal operation the pressure release mechanism while drilling a wellbore. A lubricant pressure compensating system incorporating teachings of the present disclosure may increase reliability and increase robustness or downhole service life of an associated roller cone drill bit as compared with prior roller cone drill bits.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
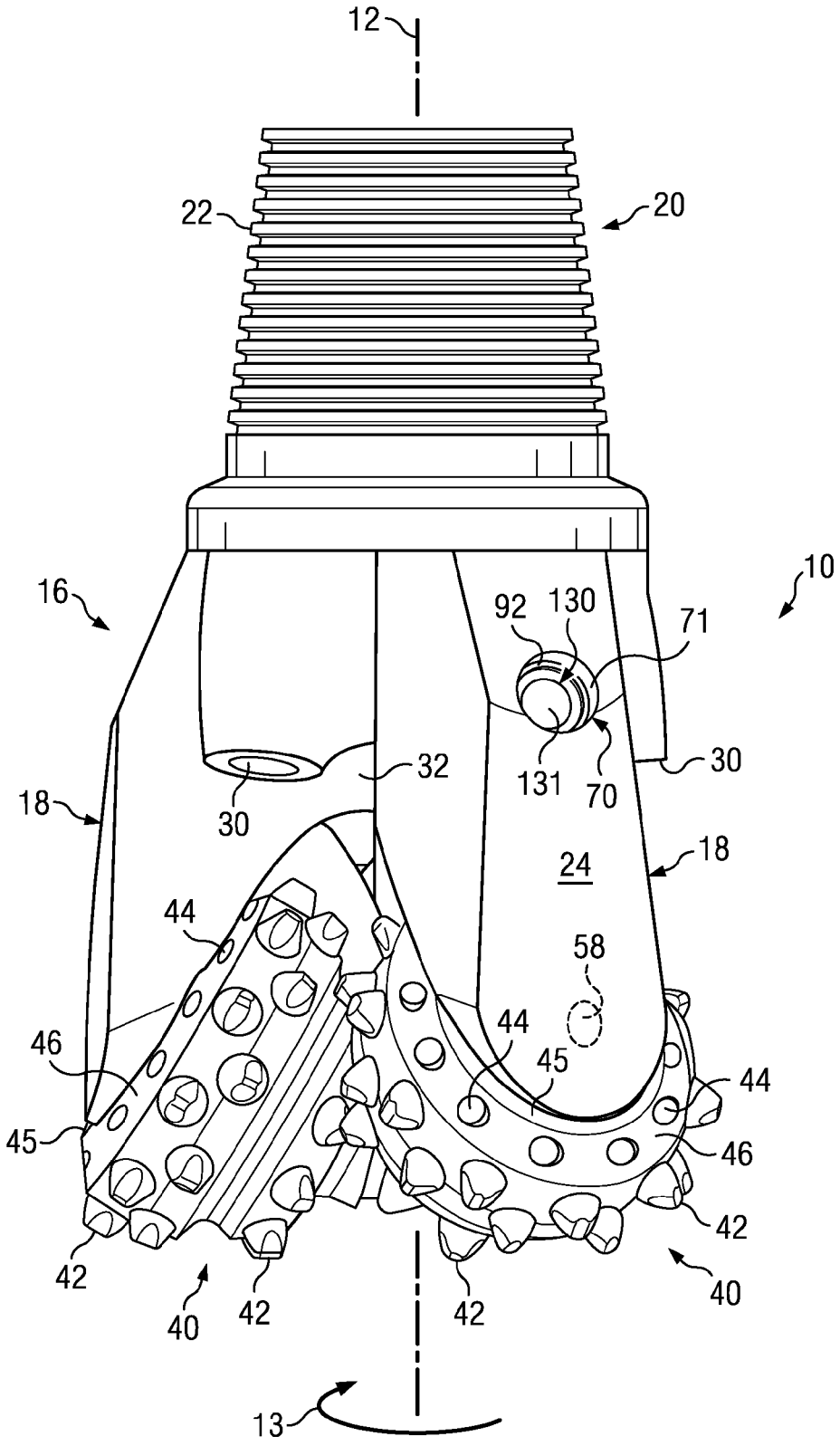
FIG. 1 is a schematic drawing showing an isometric view of one example of a roller cone drill bit incorporating teachings of the present disclosure.

Some embodiments of the present disclosure and associated advantages may be understood by reference to FIGS. 1-5 wherein like numbers refer to same and like parts.

The terms "cutting element" and "cutting elements" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit.

The terms "cone assembly" and "cone assemblies" may be used in this application to refer to a wide variety of "roller cones", "rotary cone cutters", "roller cone cutters", "rotary cutter assemblies" and "cutter cone assemblies."

The terms "lubricant" and "lubricants" may be used in this application to refer to any fluid, grease, composite grease or mixture of fluids and solids satisfactory for lubricating journal bearings, thrust bearings, bearing surfaces, bearing assemblies and/or other supporting structures associated with rotatably mounting one or more cone assemblies on a roller cone drill bit.

The terms "roller cone drill bit" and "roller cone drill bits" may be used in this application to include various types of rotary cone drill bits, rock drill bits, cutter cone drill bits and rock bits. Roller cone drill bits may have at least one support arm with a respective cone assembly rotatably disposed thereon.

The terms "seal" or "fluid seal" may be used to refer to a wide variety of seals and seal assemblies including, but not limited to, an o-ring seal, t-seal, v-seal, flat seal, lip seal and any other seal or seal assembly operable to establish a fluid barrier between adjacent components or sealing surfaces.

Downhole well fluids associated with forming a wellbore may include, but are not limited to, drilling fluids, formation fluids, formation cuttings and other downhole debris. Downhole well fluids may include highly corrosive gases and/or liquids. Formation cuttings and other downhole debris may often include highly abrasive particulate matter which may damage various components associated with roller cone drill bits. Large or undesired differences between pressure of well fluids disposed on exterior portions of a roller cone drill bit and pressure of lubricants disposed within associated lubricant systems may result in damage to or extrusion of one or more seals followed by loss of lubricant and/or well fluids contacting and damaging associated bearings, bearing surfaces and/or supporting structures.

If damage occurs to journals, spindles, bearings, bearing assemblies, bearing surfaces, seals and/or other supporting structure associated with rotation of a roller cone or cone assembly relative to an associated support arm and/or lubrication systems to protect such components, the associated roller cone drill bit and attached drill string must generally be removed from the wellbore to replace damaged components and/or to replace the roller cone drill bit.

Filling a lubricant system with lubricant and maintaining desired lubricant system pressure relative to adjacent downhole well fluid pressure in accordance with teachings of the present disclosure may increase downhole drilling life of a roller cone drill bit by maintaining desired pressure differential between adjacent downhole well fluids and lubricant system pressure to protect associated seals, bearings, journals, bearing surfaces, bearing assemblies and/or other supporting structures associated with rotation of a roller cone assembly relative to the associated support arm.

The terms "relief mechanism" and "pressure relief mechanism" may be used in this application to include a wide variety of pressure relief valves, seals, biasing means, springs, pistons, sealing surfaces and other mechanisms incorporating teachings of the present disclosure which may be operable to maintain desired differences between lubricant pressure within portions of a roller cone drill bit and downhole well fluid pressure acting on exterior portions of the roller cone drill bit in accordance with teachings of the present disclosure. Such differences in pressure may also be referred to as "differential pressure" or "differential pressures."

The terms "biasing mechanism" and/or "biasing mechanisms" may be used to refer to a wide variety of springs, bellows and other mechanisms satisfactory to retain a pressure release mechanism in a first, closed position blocking fluid flow through the pressure release mechanism in accordance with teachings of the present disclosure. Such "biasing mechanisms" may also be used to return a pressure release mechanism from a second, open position to the first, closed position. Some examples of biasing mechanisms satisfactory for use with pressure relief mechanisms incorporating teachings of the present disclosure may include, but are not limited to, wave springs, Belleville washers, and Belleville springs. Some examples of wave springs may be available from Smalley Steel Ring Company located in Lake Zurich, Ill.

Various features of the present disclosure may be described with respect to roller cone drill bits, support arms, cone assemblies, pressure relief mechanisms, lubricant systems and/or associated components. Some examples are shown in FIGS. 1-5. However, teachings of the present disclosure may be used with a wide variety of roller cone drill bits and associated lubricant systems. The present disclosure is not limited to roller cone drill bits, support arms, cone assemblies, pressure relief mechanisms, locking devices and/or lubricant systems as shown in FIGS. 1-5.

Drill bit 10 as shown in FIG. 1 may be referred to as a "roller cone drill bit," "rotary cone drill bit," "rotary rock bit," or "rock bit." A drill string (not expressly shown) may be attached to and rotate drill bit 10 relative to bit rotational axis 12 (rotating as indicated by arrow 13). Cutting action associated with forming a wellbore in a downhole formation may occur as cone assemblies, indicated generally at 40, engage and roll around the bottom or downhole end of a borehole or wellbore (not shown) in response to rotation of drill bit 10.

Each cone assembly 40 may be attached with and rotate relative to exterior portions of associated spindle or journal 28. See FIG. 2. A wide variety of supporting structures and/or bearing surfaces may be used to rotatably mount each cone assembly 40 on associated spindle or journal 28. See for example bearings 14 and 15 and spindle 28 shown in FIG. 2. For some applications, bearing 14 may be described as a journal bearing. Bearing 15 may sometimes be described as a thrust bearing. For some applications, bearing surfaces associated with rotatably mounting a roller cone assembly on a spindle or journal may be formed as integral components (not expressly shown) disposed on exterior portions of an associated journal and interior portions of a cavity formed within an associated roller cone assembly.

For some applications, drill bit 10 may include bit body 16 having three support arms 18 extending therefrom. Only two support arms 18 may be seen in FIG. 1, but the teachings of the present disclosure may be used in drill bits with various numbers of support arms 18. Uphole portion or pin end 20 of drill bit 10 may include generally tapered, external threads 22. Threads 22 may be used to releasably engage drill bit 10 with the downhole end of an associated drill string or bottomhole assembly (not expressly shown).

Figure 2:
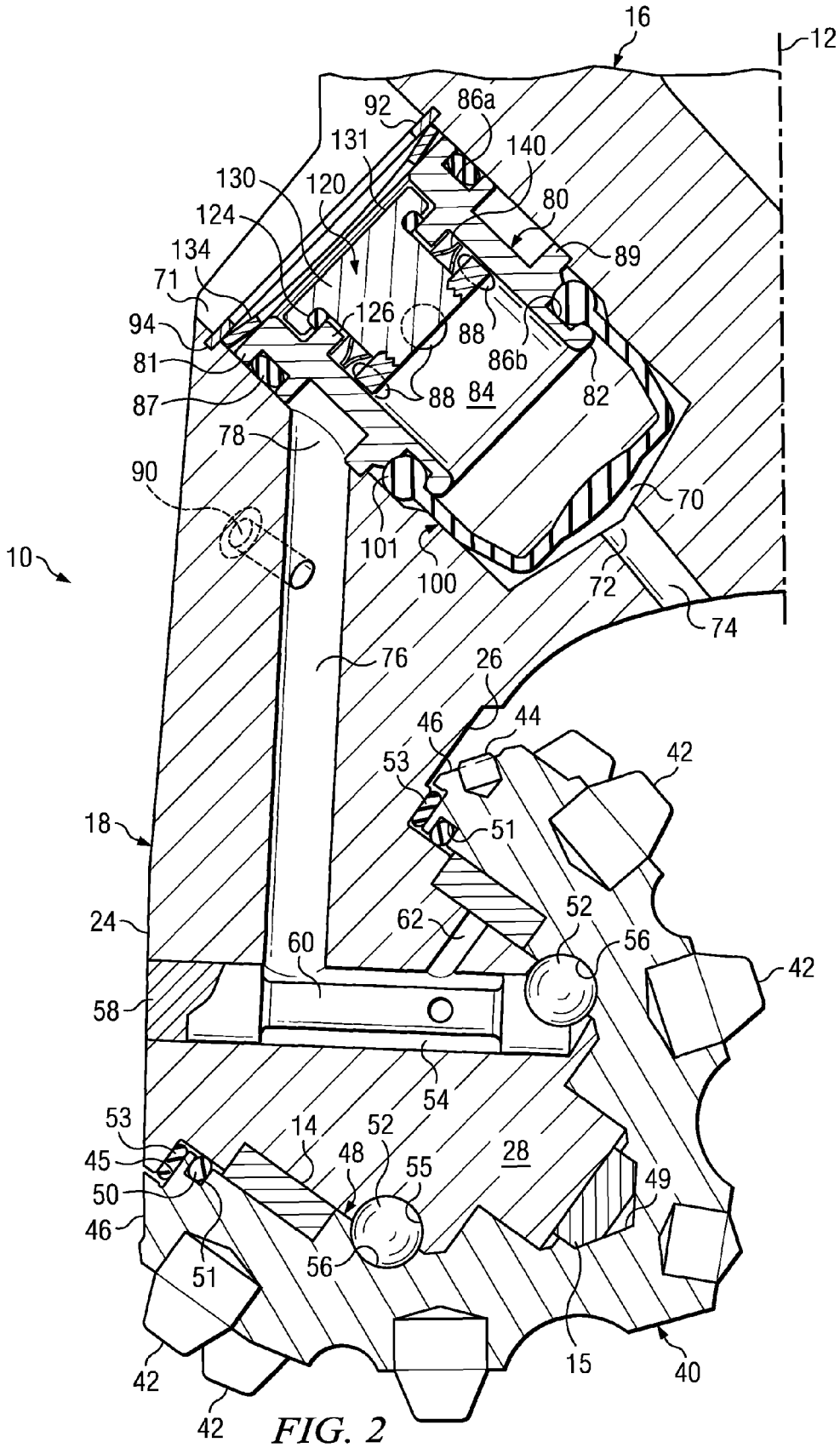
FIG. 2 is a schematic drawing in section with portions broken away showing various components of a roller cone drill bit and an associated lubrication system with a pressure relief mechanism in a first, closed position.

As shown in FIG. 2, each support arm 18 may include respective exterior surface 24 and interior surface 26 which are normally exposed to downhole well fluids while forming a wellbore. Each support arm 18 may include respective journal or spindle 28 formed as an integral component thereof. Respective cone assembly 40 may be rotatably mounted on each journal 28. Each journal 28 may be angled downwardly and inwardly with respect to bit rotational axis 12 and interior surface 26 of associated support arm 18 so that attached cone assembly 40 may engage the bottom or end of a wellbore (not expressly shown) during rotation of drill bit 10. For some applications, journal 28 may also be tilted at an angle of zero to three or four degrees in the direction of rotation of drill bit 10. See arrow 13.

Cone assemblies 40 may include a plurality of cutting elements or inserts 42 which penetrate and scrape against adjacent portions of a downhole formation (not expressly shown) in response to rotation of drill bit 10. Cone assemblies 40 may also include a plurality of compacts 44 disposed on respective gauge surface 46 of each cone assembly 40.

Formation materials and other downhole debris created during impact between cutting elements or inserts 42 and adjacent portions of a downhole formation may be carried from the bottom or end of an associated wellbore by drilling fluid flowing from nozzles 30. See FIG. 1. Such drilling fluid may be supplied to drill bit 10 by a drill string (not expressly shown) attached to threads 22. Drilling fluid with formation cuttings and other downhole debris may flow upwardly around exterior portions of drill bit 10 and through an annulus (not expressly shown) formed between exterior portions of drill bit 10 and exterior portions of an attached drill string and inside diameter or side wall of the wellbore to an associated well surface (not expressly shown).

Each cone assembly 40 may be rotatably mounted on associated journal or spindle 28 in a substantially similar manner. Accordingly, only one support arm 18, spindle 28 and cone assembly 40 will be described in detail. As shown in FIG. 2, cone assembly 40 may include generally circular base portion 45 with cavity 48 extending inwardly therefrom. Cavity 48 (sometimes referred to as a "cone cavity") may have a generally cylindrical configuration sized to receive exterior portions of associated journal 28 therein. Associated gage surface 46 may extend radially outward and tapered relative to respective base portion 45.

Bearing 14 may be disposed between exterior portions of spindle 28 and interior portions of cone cavity 48. Thrust bearing 15 may be disposed between the end of spindle 28 opposite from support arm 18 and interior end 49 of cavity 48 formed in cone assembly 40 opposite from base portion 45. A wide variety of bearings, bearing surfaces and other types of supporting structures may also be disposed between exterior portions of spindle 28 and interior portions of cavity 48. The present disclosure is not limited to bearing 14 and/or bearing 15.

Seal 50 may be disposed within retaining groove 51 within cavity 48 proximate base portion 45 to establish a fluid barrier between adjacent portions of cavity 48 and adjacent portions of journal 28. One or more seals or a combination of seals and backup rings may be positioned within one or more retaining grooves or otherwise disposed between cone cavity 48 and journal 28. See for example wiper ring or backup seal 53. Seal 50 may be located in cavity 48 proximate an opening in base portion 45 of cone assembly 40. Elastomeric seal 50 may form a fluid seal or fluid barrier between adjacent interior portions of cavity 48 and adjacent exterior portions of journal 28. Seal 50 may be operable to prevent downhole well fluids, formation cuttings and/or downhole debris from entering cavity 48 and damaging associated bearing surfaces and supporting structures. Wiper ring or backup seal 53 may sometimes be located outwardly from fluid seal 50. Seal 53 may provide a barrier to block contact between downhole well fluids and seal 50.

Cone assembly 40 may be retained on journal 28 by a plurality of ball bearings 52 inserted through ball passage 54 formed in support arm 18 extending from exterior surface 24 through portions of journal 28. See FIG. 2. Ball bearings 52 may be disposed in an annular array (not expressly shown) within associated ball race 55 formed in exterior portion of journal 28 and ball race 56 formed in adjacent interior portions of cavity 48 of cone assembly 40. Once inserted, ball bearings 52 prevent disengagement of cone assembly 40 from journal 28. Ball passage 54 may be plugged or blocked by welding ball plug 58 into ball passage 54. Ball plug 58 may include necked down or reduced diameter portion 60 which may be sized to accommodate lubricant flow to bearing 14 and/or bearing 15.

Each support arm 18 may include a respective lubricant system defined in part by lubricant system chamber or cavity 70 and associated components. See FIGS. 2 and 3. Lubricant system chamber or cavity 70 may include first end or opening 71 in communication with downhole well fluid pressure adjacent to exterior portion 24 of associated support arm 18. Each lubricant system chamber or cavity 70 may include second end 72 with passageway 74 extending therefrom. Each passageway 74 may communicate pressure of downhole well fluids adjacent to interior surface 26 of associated support arm 18 with second end 72 of associated lubricant system cavity 70.

Respective lubricant container 80 may be disposed within lubricant system cavity 70. Lubricant container 80 may sometimes be referred to as a "reservoir" or "canister." Lubricant container 80 may sometimes have a generally hollow, cylindrical configuration defined in part by bore 84 extending between first end 81 and second end 82. First end 81 of lubricant container 80 may be disposed proximate first end 71 of respective lubricant system cavity 70. Second end 82 of lubricant container 80 may be disposed within respective lubricant system cavity 70 intermediate first end 71 and second end 72.

Lubricant passageway 76 may be formed in and extend from opening 78 formed in lubricant system cavity 70 through associated support arm 18 to allow communication of lubricant between lubricant system cavity 70 and ball passageway 54. For some applications, opening 78 from lubricant passageway 76 into associated lubricant system cavity 70 may be generally aligned with one or more openings 88 formed in exterior portions of associated lubricant container 80. See FIGS. 3 and 4. For embodiments such as shown in FIGS. 2-5, lubricant may be communicated between lubricant container 80 and ball passageway 54 via one or more openings 88 in exterior portions of container 80, opening 78 and associated lubricant passageway 76. One or more conduits 62 may also be provided to communicate lubricant between ball passageway 54 and bearings 14 and/or 15.

For embodiments such as shown in FIGS. 2-5, lubricant container 80 may be described as having a generally cylindrical configuration defined in part by first end 81 and second 82 with bore 84 extending therebetween. Pressure relief mechanism 120 may be slidably disposed within bore 84 of lubricant container 80 proximate first end 81. For some applications, pressure relief mechanism 120 may sometimes be described as a "pressure relief valve." For some embodiments pressure relief mechanism 120 may include piston 130, fluid seal 124, biasing means 134 and threaded collar (See FIGS. 2, 3 and 4).

For some embodiments pressure relief mechanism 120 may include piston 130 slidably disposed within bore 84 proximate first end 81. First end 131 of piston 130 may have a substantially enlarged outside diameter as compared with second end 132 of piston 130. See for example FIG. 4.

Figure 5:
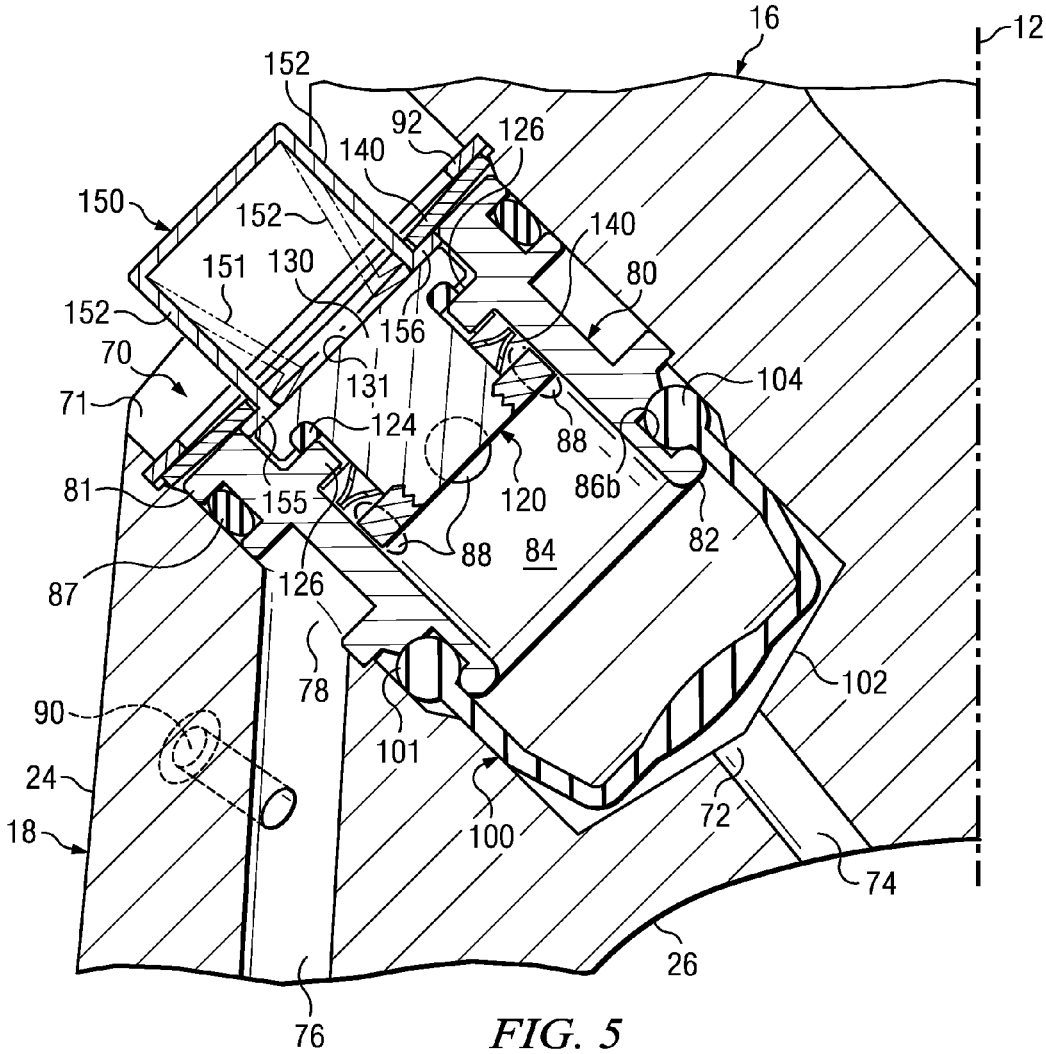
FIG. 5 is a schematic drawing in section with portions broken away with the pressure relief mechanism of FIG. 3 releasably locked in the first, closed position to accommodate filling the lubricant system with lubricant in accordance with teachings of the present disclosure.

Annular ring or shoulder 126 may be formed within bore 84 spaced from first end 81 of lubricant container 80. The dimensions of first end 131 of piston 130 are selected to be larger than portions of bore 84 extending through annular ring or shoulder 126. Fluid seal 124 may be formed on interior portions of first end 131 facing annular ring 126. An appropriate sealing surface may be formed on portions of annular ring or shoulder 126 facing fluid seal 124. Contact between seal 124 disposed on first end 131 of piston 130 may form a fluid seal with adjacent portions of annular ring 126 to block communication between downhole well fluids proximate opening 71 and lubricants disposed within bore 84 when pressure release mechanism 120 is in its first, closed position. The first, closed position with fluid seal 124 in contact with annular ring 126 is shown in FIGS. 2 and 5.

Prior to installation of lubricant container 80 within lubrication system cavity 70, second end 132 of piston 130 may be inserted through first end 181 of lubricant container 80. Biasing means 140 may be slidably disposed over exterior portions of piston 130 extending from annular ring 126. See FIGS. 3 and 4. A plurality of threads **134*a* may be formed on exterior portions of piston 130 proximate second end 132. Threads 134*a* may be sized to releasably engage threads 134*b* formed on interior portions of threaded collar 138. Engagement between threads 134*a* and 134*b* will result in securely engaging biasing mechanism 140 or on exterior portions of lubricant container 80 disposed within longitudinal bore 84**.

In another embodiment, exterior portions of piston 130 may be sized to fit within interior portions of collar 138 and connected without threads. For example, an exterior dimension of piston 130 may be slightly larger than an interior dimension of collar 138 to create an interference fit. In another example, piston 130 may be press fit within collar 138. In other examples, piston 130 and collar 138 may be connected with a snap ring and/or a retaining ring.

Biasing mechanism 140 may include first end 141 sized to engage annular ring or shoulder 126 opposite from seal 124. Second end 142 of biasing means 140 may be engaged by threaded collar 138. Interior 144 of biasing means 140 may be disposed between first end 141 and second end 142. Downhole operating performance and downhole operating life of biasing means 140 may be enhanced by completely disposing biasing means 140 within lubricant contained within bore 84.

For some applications annular recess or groove **86*a* may be formed in exterior portions of lubricant container 80 proximate first end 81. Various types of seals including, but not limited to, seal ring 87 may be disposed within annular recess 86*a* to prevent fluid communication between first opening 71 and interior portions of lubricant system chamber 70 and contamination of lubricant disposed within lubricant container 80**.

For some applications, annular ring or shoulder 79 may be formed on interior portions of lubricant system chamber 70 between opening 78 and second end 72. Corresponding annular collar or ring 89 may be formed on exterior portions of lubricant container 80. The location of annular ring 89 relative to first end 81 and second end 82 of lubricant container 84 may be selected to generally align openings 88 disposed in the exterior portions of lubricant container 80 with opening 78 in fluid passageway 76. The location of annular ring 89 relative to annular shoulder 79 may also be selected such that first end 81 of lubricant container 80 will be disposed beneath or spaced from recess 94 formed on interior portions of lubricant system cavity 70 proximate first end 71.

For some applications, retainer ring 92 may be inserted into groove 94 formed within interior portions of lubricant system chamber 70 proximate first end 71 to releasably install lubricant container 80 therein. For some applications, a biasing mechanism such as Belleville washer 96 may be disposed between retainer ring 92 and first end 81 of lubricant container 80. Belleville washer 96 may prevent "fretting" of lubricant container 80 and associated components within lubricant system cavity 70 during drilling of a wellbore.

Belleville washer 96 or other satisfactory biasing mechanisms may be disposed on first end 81 of lubricant container 80 prior to installing retainer ring 92 in groove 94. For some applications, retainer ring 92 may be described as a "snap ring." However, a wide variety of retaining devices and/or biasing mechanisms may be satisfactorily used to releasably install lubricant container 80 within lubricant system cavity 70. The present disclosure is not limited to use of snap rings and/or Belleville washers for the installation of lubricant container 80 within lubricant system cavity 70.

For some applications flexible diaphragm or cap 100 may be attached to and extend from second end 82 of lubricant container 80. Flexible diaphragm or cap 100 may prevent undesired contamination of lubricant disposed within lubricant container 80 and at the same time allow communication of lubricant pressure with downhole well fluid pressure proximate second end 72 of lubricant system cavity 70.

Second end 82 of lubricant container 80 may include annular recess **86*b* operable to receive first end 101 of flexible diaphragm 100 therein. Flexible diaphragm 100 may be used to close second end 82 of lubricant container 80 to prevent contamination of lubricant disposed with lubricant container 80 by downhole well fluids disposed in passageway 74. The volume of lubricant contained within lubricant system cavity 70 may be defined in part by the volume of bore 84 in lubricant container 80 when pressure relief mechanism 120 is in its first, closed position and interior volume of flexible diaphragm 100**.

Flexible diaphragm or cap 100 may be described as having a generally cylindrical configuration with an opening formed proximate first end 101 sized to receive second end 82 of lubricant container 80 therein. Enlarged annular ring 104 may be formed on exterior portions of flexible diaphragm 100 proximate first end 101. The dimensions of annular ring 104 may be selected to be compatible with annular recess **86*b* formed in exterior portions of lubricant container 80 proximate second end 82. The dimensions and configuration of annular ring 104 may also be selected to form a generally fluid tight seal between adjacent interior portions of lubricant cavity 70 and portions of annular recess 86*b* in lubricant container 80**.

For some downhole drilling conditions the pressure of downhole well fluids adjacent to interior surface 26 of support arm 18 may communicate through passageway 74 and move or compress lubricant flexible cap 100 to a first, generally retracted position relative to second end 72 lubricant system cavity 70. See FIG. 2. In this retracted position, downhole well fluids may be exposed to exterior portions of flexible cap or diaphragm 100. Compression of flexible cap 100 by downhole well fluid pressure may increase the pressure of lubricant supplied from lubricant container 80 to seal 50 via passageway 76 and ball passageway 54. Increasing lubricant system pressure in response to increase downhole well fluid pressure helps to protect fluid seal 50 by maintaining desired pressure differential across seal 50.

For some downhole drilling conditions the pressure differential across seal 50 may be approximately zero (0) psi. For other downhole drilling conditions the pressure differential may be less than one hundred (100) psi. Biasing mechanism 140 and other component of pressure relief mechanism 120 may be selected to limit differential pressure across seal 50 to less than a maximum design value for the associated rotary drill bit. Pressure relief mechanism 120 is designed to relieve internal pressure at a differential of approximately 100 psi or less, but can be modified by changing spring force associated with biasing mechanism 140.

Figure 3:
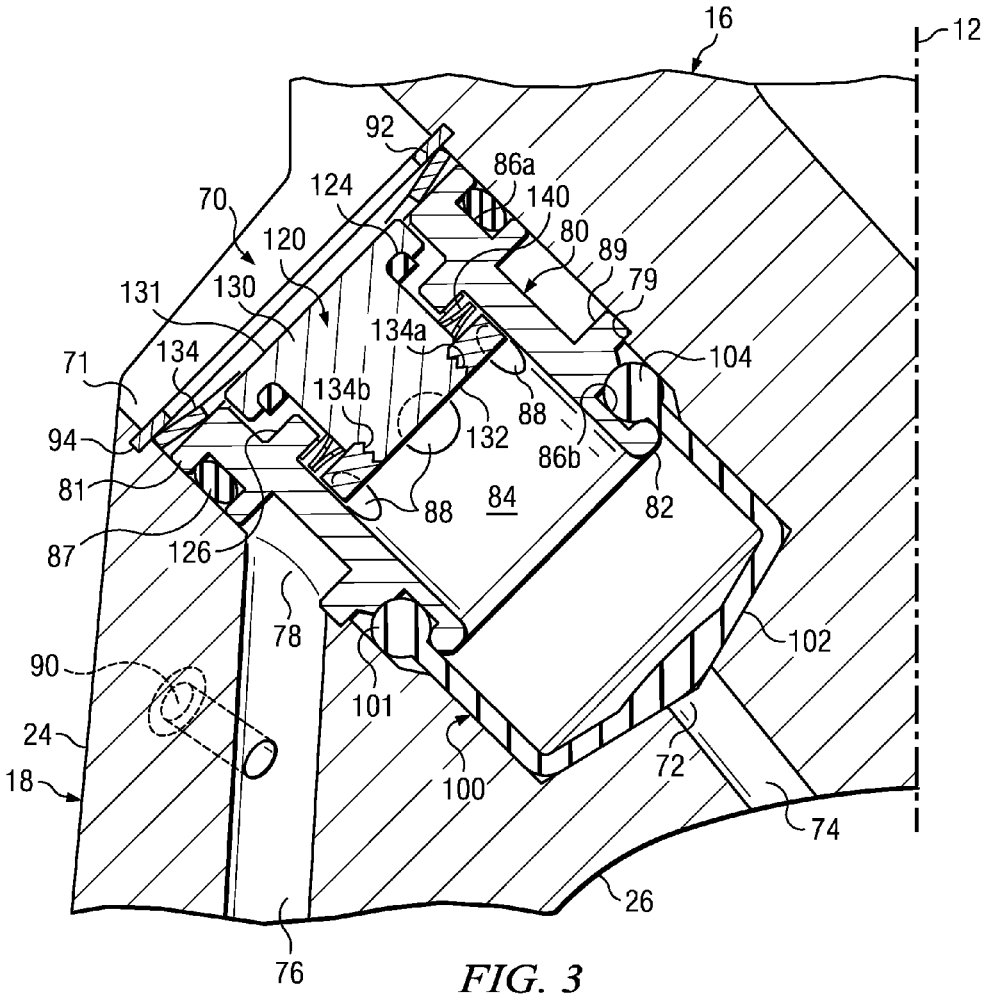
FIG. 3 is a schematic drawing in section with portions broken away showing various components of FIG. 2 including the pressure relief mechanism in a second, open position operable to reduce lubricant system pressure in accordance with teachings of the present disclosure.

For other downhole drilling conditions, the pressure of lubricant contained within lubricant container 80 and flexible diaphragm or cap 100 may be greater than the well fluid pressure in passageway 74. During such downhole drilling conditions, flexible diaphragm or cap 100 may expand to an enlarged position such as shown in FIG. 3.

Under normal downhole drilling conditions flexible diaphragm or cap 100 may alternately expand and control as needed to maintain desired pressure differential across associate lubricant seal 50. A pressure differential of approximately zero (0) may substantially increase the downhole drilling life of seal 50 and components associated with rotation of cone assembly 40.

The pressure of lubricant within lubricant container 80 and flexible diaphragm 100 may increase in response to increased downhole temperature or other downhole drilling conditions. Lubricant pressure within container 80 and flexible cap 100 may also increase in response to increased temperature associated with forming a wellbore in relatively hard or difficult drilling conditions which produces increased friction and heating during rotation of roller cone assembly 40 relative to associated spindle 18.

Downhole well fluid pressure surrounding exterior portions of drill bit 10 may be transmitted to lubricant disposed in lubricant container 80 by flexing of diaphragm 100. Such flexing of diaphragm 100 may maintain lubricant pressure generally equal to the pressure of the downhole well fluid pressure adjacent to drill bit 10. This pressure may be transmitted through lubricant passage 76, ball passage 54, conduit 78 and internal cavity 62 to the an inner face of elastomeric seal 50. As a result seal 50 may be exposed to an internal pressure from the lubricant generally equal to the pressure of the external fluids. Maintaining very small or approximately zero differential pressure across fluid seal 50 may prevent damage to fluid seal 50 and substantially increase downhole drilling life of drill bit 10.

For embodiments such as shown in FIG. 5 pressure relief mechanism 120 may be temporarily locked in its first closed position by inserting portions of locking device 150 between first end 131 of piston 130 and adjacent portions of Belleville washer and/or snap ring 76. A wide variety of locking devices other than locking device 150 may be satisfactorily used to hold pressure release mechanism 130 in its first, closed position while filling an associated roller cone drill bit with lubricant.

For some applications, locking device 150 may also be described as a "temporary locking device". Locking device 150 may also be described as a "releasable clip" having first flexible leg 151 and second flexible leg 152. See FIGS. 4 and 5. Each flexible leg 151 and 152 may extend from associated base 154. Respective flange or shoulder 152 may extend radially outward from the end of flexible leg 151 opposite from base 154.

Corresponding respective flange or shoulder 156 may extend radially outward from second flexible leg 152 opposite from base 154.

After installation of lubricant reservoir or container 80 in associated lubricant system cavity 70, locking device 150 may be satisfactorily used to releasably hold or lock pressure relief mechanism 130 in its first, closed position. As shown in FIG. 5, first leg 151 and second leg 152 may be flexed radially inward to allow insertion and/or removal from associated flanges or shoulders 155 and 156 between first end 131 of piston 130 and adjacent portions of spring or Belleville washer 140. The dimensions of each flange or shoulder 155 and 156 may be selected to securely fit between adjacent portions of first surface 131 and adjacent portions of Belleville washer 140.

Figure 4:
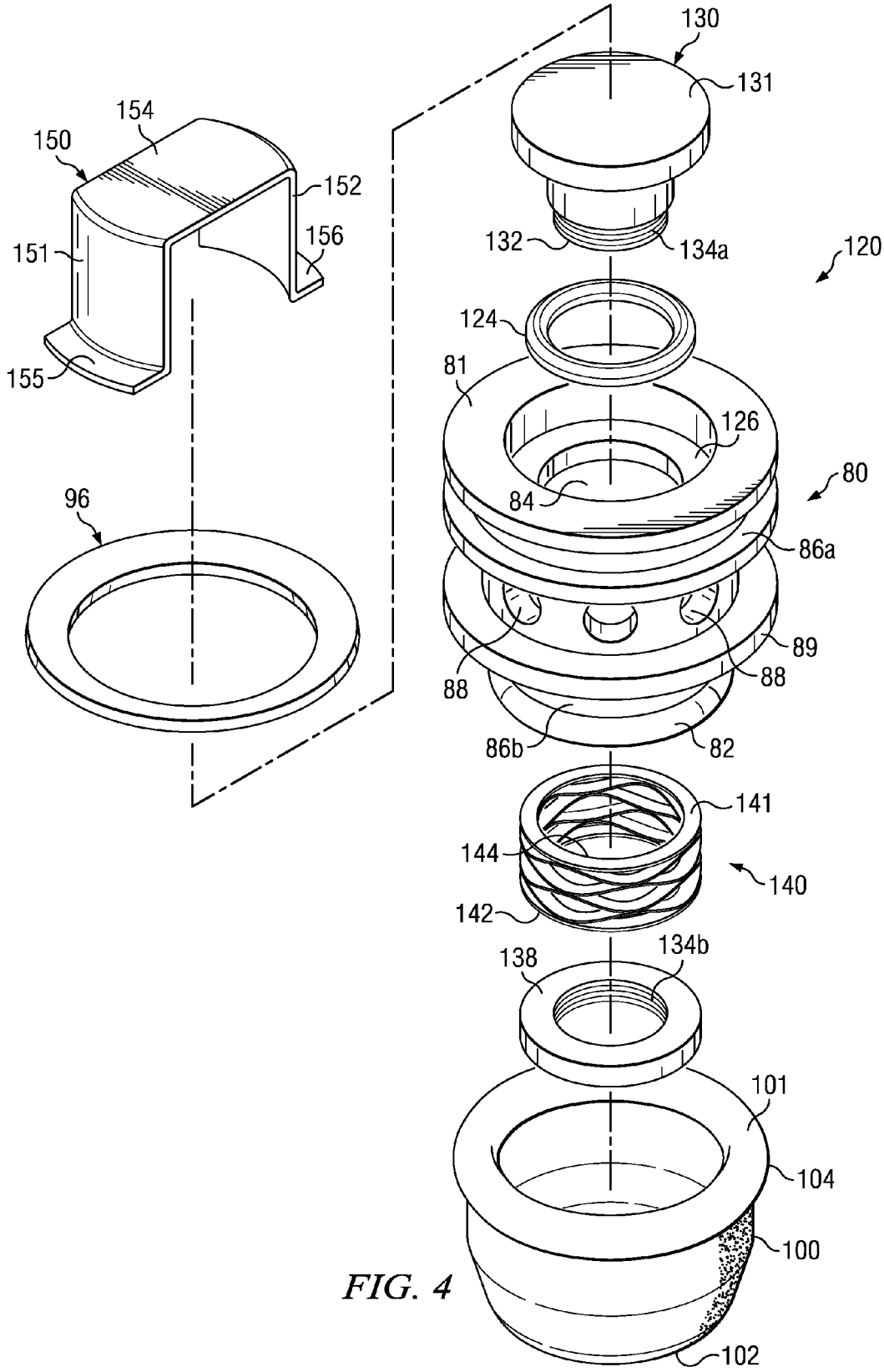
FIG. 4 is a schematic drawing showing an exploded, isometric view of one example of a lubricant container and associated pressure relief mechanism incorporating teachings of the present disclosure.

For embodiments such as shown in FIGS. 4 and 5, respective flange or shoulders 155 and 156 may be releasably inserted between first surface 131 and adjacent portions of Belleville washer 140 to securely engage fluid seal 124 with adjacent portions of sealing surface 126. As previously noted, engagement between fluid seal 124 and sealing surface 126 prevents communication between lubricants disposed within lubricant reservoir 80 and downhole well fluids adjacent to first opening 71 in lubricant system cavity 70.

After releasably locking pressure relief mechanism 120 in its first, closed position, lubricant may be added through port 90 into lubricant passageway 76 to fill both lubricant container 80, lubricant passageway 76, ball passageway 54 and any gaps or void spaces formed between the exterior of spindle 28 and adjacent portions of cone cavity 48. By temporarily locking pressure relief mechanism 120 in its first, closed position, increased lubricant pressure may be applied via port 90 to ensure complete filling of such void spaces and interior portions of flexible diaphragm or cap 100.

Although the present disclosure and its advantages have been described in detail, it should be understood that various changes, substitutions and alternations can be made herein without departing from the spirit and scope of the disclosure as defined by the following claims.

What is claimed is:

1. A roller cone drill bit operable to form a wellbore extending through a downhole formation comprising:

a bit body having at least one support arm extending therefrom;

a respective cone assembly rotatably mounted on a journal extending from each support arm;

a respective lubricant container disposed in each of the at least one support arms;

a lubricant passageway disposed in each of the at least one support arms to communicate lubricant between the respective lubricant container and at least one bearing surface associated with rotation of the respective cone assembly mounted on each of the at least one support arms;

at least one opening formed in exterior portions of the lubricant container to accommodate communication of lubricant with the lubricant passageway;

the lubricant container having a first end exposed to downhole well fluid pressure while drilling the wellbore;

a pressure release mechanism disposed within the first end of the lubricant container;

the pressure release mechanism operable to release lubricant from the first opening in the lubricant container when lubricant pressure within the lubricant container exceeds pressure of downhole well fluids proximate to the first opening of the lubricant container by a selected amount;

the pressure release mechanism including a piston disposed within the first end of the lubricant container;

the piston having a first, closed position blocking release of lubricant through first opening in the lubricant container;

the piston having a second, open position operable to allow release of lubricant through the first opening in the lubricant container; and a biasing mechanism disposed within the lubricant container to maintain the pressure relief mechanism in its first, closed position until lubricant pressure in the lubricant container exceeds downhole well fluid pressure adjacent to the first end of the lubricant container by the selected amount.

2. The roller cone drill bit of claim 1 wherein the pressure relief mechanism further comprises:

the biasing mechanism completely disposed within the lubricant container and engaged with the piston;

a fluid seal disposed proximate the first end of the lubricant container;

an enlarged surface formed on exterior portions of the piston extending from the first opening in the lubricant container; and the enlarged surface formed on exterior portions of the piston operable to engage the fluid seal disposed proximate the first end of the lubricant container when the pressure release mechanism is in its first, closed position; and the enlarged surface formed on exterior portions of the piston spaced from the fluid seal disposed proximate the first end of lubricant container when the pressure release mechanism is in its second, open position.

3. The roller cone drill bit of claim 1 wherein the biasing mechanism further comprises a spring disposed within the lubricant container to move the piston from the second, open position to the first, closed position when the downhole well fluid pressure no longer exceeds lubricant pressure by the selected amount.

4. The roller cone drill bit of claim 1 further comprising:

a flexible diaphragm attached to a second end of the lubricant container to prevent contamination of lubricant disposed in the lubricant container by downhole well fluids proximate the second end of the lubricant container; and the flexible diaphragm operable to communicate lubricant pressure and downhole well fluid pressure with each other.

5. The roller cone drill bit of claim 1 further comprising each lubricant container disposed within a respective lubricant cavity formed in each of the at least one support arms.

6. The roller cone drill bit of claim 1 further comprising:

a first fluid seal disposed on exterior portions of the lubricant container proximate the first end of the lubricant container; and a second fluid seal disposed on exterior portions of the lubricant container proximate a second end of the lubricant container whereby the first fluid seal and the second fluid seal prevent contamination of downhole well fluids with lubricant and the at least one lubricant passageway.

7. A roller cone drill bit having a bit body with at least one support arm extending therefrom and a respective cone assembly rotatably mounted on each of the at least one support arms comprising;

a respective lubricant cavity disposed in each of the at least one support arms;

each of the lubricant cavities having a respective first opening and a respective second opening;

a respective lubricant reservoir disposed within each of the lubricant cavities;

a respective lubricant passageway disposed in each of the at least one support arms to release lubricant from the respective lubricant reservoir and to bearing surfaces associated with rotating each cone assembly relative to the respective support arm;

each lubricant reservoir having a generally open bore extending between a respective first end and a respective second end of the respective lubricant reservoir;

the first end of each lubricant reservoir disposed proximate to the first opening in the respective lubricant cavity;

the second end of each lubricant reservoir disposed within the respective lubricant cavity intermediate the first end and the second end of the respective lubricant cavity;

at least one opening formed in exterior portions of each lubricant reservoir intermediate the first end and the second end of the respective lubricant reservoir;

the openings operable to release lubricant to the respective lubricant passageway whereby lubricant may travel from interior portions of the respective lubricant reservoir and to the bearing surfaces associated with the respective cone assembly;

a respective first fluid seal disposed proximate the first end of each lubricant reservoir;

a respective second fluid seal disposed proximate the second end of each lubricant reservoir;

each first fluid seal and each second fluid seal operable to prevent communication of downhole well fluids with the respective lubricant passageway;

a respective flexible cap attached to the second end of each lubricant reservoir;

the flexible cap disposed proximate the second opening in the respective lubricant cavity;

the flexible cap operable to prevent contamination of lubricant contained within the lubricant reservoir by downhole well fluids;

a respective pressure release mechanism disposed within the first end of each lubricant reservoir;

each pressure release mechanism operable to communicate lubricant with the first opening in the respective lubricant cavity when lubricant pressure within the lubricant reservoir exceeds pressure of downhole well fluids proximate to the first opening by a selected amount;

each pressure release mechanism having a second position operable to allow communication of lubricant with the first opening in the lubricant cavity;

the first opening and the second opening in each of the lubricant cavities exposed to downhole well fluid pressure;

a biasing mechanism disposed within the lubricant reservoir; and the biasing mechanism operable to maintain the pressure relief mechanism in its first, closed position until the pressure of lubricant in the respective lubricant reservoir exceeds adjacent downhole well fluid pressure by a select amount.

8. The roller cone drill bit of claim 7 wherein each pressure relief mechanism further comprises:

a respective piston slidably disposed within an opening formed in the first end of each lubricant reservoir;

the biasing mechanism disposed within each lubricant reservoir and engaged with the respective piston;

a respective fluid seal disposed proximate the first end of each lubricant reservoir;

a respective enlarged sealing surface disposed on exterior portions of each piston;

the respective enlarged sealing surface disposed on each piston operable to engage the fluid seal disposed proximate the first end of the respective lubricant reservoir when the respective pressure release mechanism is in its first, closed position; and the enlarged sealing surface disposed on the respective piston spaced from the respective fluid seal when the respective pressure release mechanism is in its second, open position.

9. The roller cone drill bit of claim 7 wherein each biasing mechanism further comprises:

a respective spring disposed within each lubricant reservoir; and each spring operable to bias the respective slidable piston to the first, closed position.

10. The roller cone drill bit of claim 7 further comprising a respective flexible cap attached to the second end of each lubricant reservoir cooperating with the respective pressure relief mechanism to prevent differences between lubricant system pressure and downhole well fluid pressure from causing extrusion of the at least one seal associated with rotatably mounting each cone assembly on the respective support arm.

11. The roller cone drill bit of claim 7 further comprising:

each pressure release mechanism including a respective slidable piston disposed within the first end of each lubricant reservoir; and each slidable piston having a first position blocking communication of lubricant between interior portions of the lubricant reservoir and the first opening in the lubricant cavity.

12. A rotary cone drill bit operable to form a wellbore in downhole formation comprising:

a bit body having three support arms extending therefrom;

a respective cone assembly rotatably mounted on a spindle extending from each of the at least one support arms;

a respective lubricant container disposed in a respective lubricant cavity formed in each of the at least one support arms;

at least one lubricant passageway disposed in each of the at least one support arms to communicate lubricant disposed within each lubricant container to supporting structures associated with rotatably mounting the respective cone assembly on the support arm;

each lubricant container having a first end and a second end with a generally open bore extending between the first end and the second end of the respective lubricant container;

the first end of each lubricant container disposed proximate to a first opening in the respective lubricant cavity;

the second end of each lubricant container disposed in the respective lubricant cavity intermediate the first end and the second end of the respective lubricant cavity;

a plurality of openings formed in exterior portions of each lubricant container intermediate the first end and the second end of the respective lubricant container;

the openings operable to communicate lubricant with the at least one lubricant passageway disposed in the respective support arm whereby lubricant may flow between interior portions of each lubricant container and the support structures associated with rotating the respective cone assemblies;

a first fluid seal disposed proximate the first end of each lubricant container;

a second fluid seal disposed proximate the second end of each lubricant container;

each first fluid seal and each second fluid seal operable to prevent contamination of downhole well fluids with the associated at least one lubricant passageway;

a respective flexible diaphragm attached to the second end of each lubricant container proximate the second opening in the lubricant cavity;

each flexible diaphragm operable to prevent contamination of well fluids between the second opening and the lubricant cavity and the lubricant contained within the lubricant reservoir;

a pressure release mechanism disposed within the first end of each lubricant container and operable to communicate lubricant pressure with the first opening in the lubricant cavity when lubricant pressure within each lubricant container exceeds the pressure of downhole well fluids proximate to the first opening by a selected amount, wherein the pressure relief mechanism comprises:

a generally cylindrical piston slidably disposed within an opening formed in the first end of each lubricant container;

the biasing mechanism disposed within each lubricant container and engaged with the slidable piston;

a fluid seal mechanism disposed on exterior portions proximate the first end of each lubricant container;

an enlarged sealing surface formed on exterior portions of the slidable piston; and the first sealing surface on the exterior portions of the piston operable to engage the seal disposed proximate the first end of each lubricant container when the pressure release mechanism is in its first, closed position; and the first sealing surface disposed on the slidable piston spaced from the second sealing surface disposed proximate the opening in the first end of lubricant container when the pressure release mechanism is in its second, open position.

13. A lubricant container for use with a lubricant system in a roller cone drill bit comprising:

the lubricant container having a first end and a second end with a generally open bore extending between the first end and the second end of the lubricant container;

the first end of the lubricant container disposed proximate to a first opening in a lubricant cavity;

the second end of the lubricant container disposed in the lubricant cavity intermediate the first end and the second end of the lubricant cavity;

at least one opening formed in exterior portion of the lubricant container intermediate the first end and the second end of the lubricant container;

each opening operable to communicate lubricant with at least one lubricant passageway disposed in a respective support arm whereby lubricant may flow between interior portions of the lubricant container and support structures associated with rotating the cone assemblies;

a first fluid seal disposed proximate the first end of the lubricant container;

a second fluid seal disposed proximate the second end of the lubricant container;

the first fluid seal and the second fluid seal operable to prevent contamination of downhole well fluids with the associated at least one lubricant passageway;

a respective flexible diaphragm attached to the second end of the lubricant container proximate the second opening in the lubricant cavity;

the flexible diaphragm operable to prevent contamination of well fluids between the second opening and the lubricant cavity and lubricant contained within a lubricant reservoir;

a pressure release mechanism disposed within the first end of the lubricant container;

the pressure release mechanism operable to communicate lubricant pressure with the first opening in the lubricant cavity when lubricant pressure within the lubricant container exceeds the pressure of downhole well fluids proximate to the first opening by a selected amount;

a spring disposed within the lubricant container; and the spring operable to bias a piston in a first, closed position.

14. A method of forming a rotary cone drill bit having a bit body with at least one support arm extending and a respective spindle extending from one end of each of the at least one support arms comprising:

forming a respective cone assembly having a plurality of cutting elements disposed on exterior portions thereof with a cone cavity extending from a base portion of the cone assembly with the cone cavity sized to receive the respective spindle therein;

forming a respective lubricant system in each of the at least one support arms defined in part by a respective lubricant cavity having a respective first opening and a respective second opening;

forming a respective lubricant passageway extending from the respective lubricant cavity in each of the at least one support arms to at least one supporting structure associated with rotation of the respective cone assembly mounted on each spindle;

forming a lubricant container have a first end and a second end with a hollow bore extending therebetween; and forming a respective pressure release mechanism for each lubricant container including a piston slidably disposed within the first end of the lubricant container and a biasing means disposed within the lubricant container to maintain the pressure release mechanism in a first, closed position until lubricant pressure in the lubricant container exceeds adjacent downhole well pressure by a selected value.

15. The method of claim 14 further comprising:

installing each lubricant container within the respective lubricant cavity by inserting each lubricant container through a first end of the respective lubricant cavity;

installing a spring through the first end of the lubricant cavity with a portion of the spring resting on the first end of the lubricant container and the spring size to allow movement of the pressure release mechanism between its first position and its second position; and inserting a snap ring into an annular groove formed within interior portions of the lubricant cavity proximate the first end whereby the snap ring engages the spring disposed on the first end of the lubricant container to releasably secure the lubricant container within the lubricant cavity.

16. The method of claim 15 wherein installing the pressure release mechanism within the first end of the lubricant container further comprises:

inserting a flexible diaphragm attached to the second end of the lubricant container through the first opening in the lubricant cavity until an enlarged diameter portion formed on exterior portions of the lubricant container whereby the location of the shoulder relative to the first opening in the lubricant container and the enlarged portion formed on exterior portions of the lubricant container cooperate with each other to align openings formed in exterior portions of the lubricant container with the respective lubricant passageway.

17. The method of claim 14 further comprising:

installing each pressure release mechanism within the respective lubricant container by placing a biasing means over exterior portions of a piston;

inserting one end of a piston through a first opening in the respective lubricant container; and engaging a collar stop with the first end of the piston disposed within the lubricant container to securely engage the biasing means on exterior portions of the piston.

18. The method of claim 14 wherein the step of forming the pressure release mechanism further comprises:

forming one end of the piston with an enlarged diameter portion operable to engage portions of the opening in the first end of the lubricant container; and installing a fluid seal on the enlarged portion of the piston whereby movement of the piston from its second position to its first position results in contact between the fluid seal and the first opening in the lubricant container to block fluid flow therethrough.

19. The method of claim 14 further comprising:

forming exterior portions of a flexible diaphragm with an enlarged portion operable to form a fluid seal between exterior portions of the lubricant container and interior portions of the lubricant cavity to prevent contamination of downhole well fluids with lubricant disposed within the lubricant container when the lubricant container is disposed in the lubricant cavity; and attaching a flexible diaphragm having a generally cup-shaped configuration with the second end of the lubricant container.

20. The method of claim 14 further comprising:

inserting a lock into portions of the pressure relief mechanism to hold the pressure relief mechanism in its first, closed position;

inserting lubricant into the lubricant passageway through a port formed in exterior portions of the support arm whereby the lock maintains the pressure release mechanism in its first, closed position to assist in filling void spaces and gaps between interior portions of the roller cone and adjacent exterior portions of the associated spindle; and removing the lock from the pressure release mechanism after filling the respective lubricant system.

21. The method of claim 14 further comprising:

forming a fluid seal on an enlarged portion of the piston whereby movement of the piston from a first closed position to a second open position allows communication of lubricant through the first end of the lubricant container to maintain desired differential pressure between lubricant system pressure and pressure of well fluids proximate the first end of the respective lubricant cavity;

forming each lubricant container with at least one opening disposed in exterior portions of the lubricant container disposed between the first end and the second end thereof; and installing each lubricant container within a respective lubricant cavity with the openings formed in exterior portions of the lubricant container in communication with the respective lubricant passageway.

* * * * *

UNITED STATES PATENT AND TRADEMARK OFFICE

CERTIFICATE OF CORRECTION

PATENT NO. : 8,347,986 B2
APPLICATION NO. : 12/831766
DATED : January 8, 2013
INVENTOR(S) : Seth Garrett Anderle It is certified that error appears in the above-identified patent and that said Letters Patent is hereby corrected as shown below:

Title page Item [75] Inventor: Please correct the name of the sole Inventor by deleting "Seth Garrett Anderele" and replacing with --"Seth Garrett Anderle"--

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,347,986 B2
APPLICATION NO. : 12/831766
DATED : January 8, 2013
INVENTOR(S) : Seth Garrett Anderle It is certified that error appears in the above-identified patent and that said Letters Patent is hereby corrected as shown below:

Title page, Item [12], delete "Anderele" and insert --Anderle--.

Title page, Item [75] Inventor: Please correct the name of the sole Inventor by deleting "Seth Garrett Anderele" and replacing with --Seth Garrett Anderle--.

This certificate supersedes the Certificate of Correction issued January 28, 2014.

Signed and Sealed this
Twenty-fifth Day of February, 2014

Michelle K. Lee

Michelle K. Lee
*Deputy Director of the United States Patent and Trademark Office*